US005523199A

United States Patent [19]

Lau et al.

[11] Patent Number: 5,523,199

[45] Date of Patent: Jun. 4, 1996

[54] PHOTOGRAPHIC ELEMENT AND PROCESS EMPLOYING MAGENTA AZINE DYE-FORMING COUPLERS

[75] Inventors: Philip T. S. Lau, Rochester; Rakesh Jain, Penfield, both of N.Y.

[73] Assignee: Eastman Kodak Company, Rochester, N.Y.

[21] Appl. No.: 349,855

[22] Filed: Dec. 6, 1994

[51] Int. Cl.[6] ..... G03C 7/34

[52] U.S. Cl. ..... 430/552; 430/553

[58] Field of Search ..... 430/552, 553

[56] References Cited

U.S. PATENT DOCUMENTS

| | | | |
|---|---|---|---|
| 2,543,338 | 2/1951 | Schmidt et al. | 95/6 |
| 3,222,176 | 12/1965 | Jaeken | 430/552 |
| 4,009,035 | 2/1977 | Kojima et al. | 96/55 |
| 4,988,614 | 1/1991 | Ishige et al. | 430/552 |

FOREIGN PATENT DOCUMENTS

| | | | |
|---|---|---|---|
| 2529991 | 1/1976 | Germany | 430/552 |
| 1-241552 | 9/1989 | Japan | 430/553 |

OTHER PUBLICATIONS

Mees and James, *The Theory of the Photographic Process* 3rd edition, p. 387, 1966.

*Primary Examiner*—Lee C. Wright

*Attorney, Agent, or Firm*—Arthur E. Kluegel

[57] ABSTRACT

A photographic element and imaging process employ a light-sensitive silver halide emulsion layer having associated therewith a magenta azine dye-forming coupler which is a phenol having (1) an acylamino group in the 2-position wherein the amino nitrogen contains a substituent which is an aliphatic or aromatic group;

(2) hydrogen or a coupling-off group in the 4-position; and (3) a sulfonamido group in the 5-position.

20 Claims, No Drawings

PHOTOGRAPHIC ELEMENT AND PROCESS EMPLOYING MAGENTA AZINE DYE-FORMING COUPLERS

FIELD OF THE INVENTION

The present invention relates to a silver halide photographic element and process where the element contains a phenolic magenta azine dye-forming coupler.

BACKGROUND OF THE INVENTION

Color images are customarily obtained in the photographic art by reaction between an oxidation product of a silver halide color developing agent and a dye-forming coupler. Among the magenta couplers, the most extensively studied are the 5-pyrazolone and the pyrazolotriazole type couplers. Less well known are the magenta azine dye-forming couplers which were first proposed as a novel dye-forming system for color photography several decades ago (W. A. Schmidt, et al., *Ind. Eng. Chem.,* 45, 1726 (1953)). Although magenta dyes derived from azine couplers have been claimed to possess greater heat and light stability, and lower unwanted blue absorptions than the azomethine pyrazolone dyes (U.S. Pat. No. 2,543,338), the conversion of the azine coupler to the magenta dye during color development is too slow and too inefficient to be of practical use in conventional or high speed development processes. (See *The Theory of the Photographic Process,* 4th edition, p. 338, and references cited therein).

Phenolic couplers such as 2,5-diacylaminophenols are well known cyan couplers currently being used in color photographic products. Also disclosed within this class are phenolic couplers containing a 2-acylamino-5-sulfonamido substituent as represented by the following formula (U.S. Pat. No. 4,009,035).

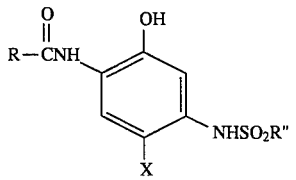

The cyan dyes produced by these couplers are known to undergo slow conversion to the magenta dye as shown in the reaction scheme below:

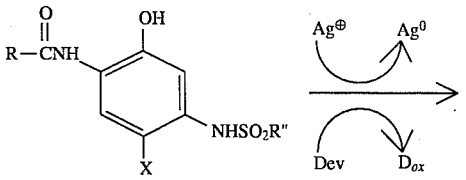

-continued

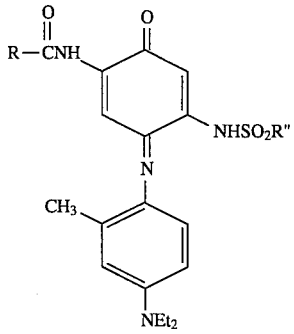

cyan dye

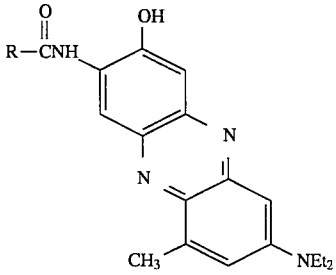

magenta azine dye

Unfortunately, the conversion of the cyan dye to the magenta azine dye will take several days or weeks to complete, thus rendering this class of couplers impractical for use either as cyan or magenta couplers. There has been an attempt to accelerate the conversion of the cyan dye to the magenta azine dye by replacing the 2-acylamido group in the phenolic ring with electron-withdrawing substituents having a Hammett sigma value of 0.3 or greater (U.S. Pat. No. 4,988,614). While this approach has led to an improvement in the conversion rate, these couplers still suffer from incomplete conversion to the magenta azine dye within the photographic processing time frame e.g. six minutes or less. In addition, the starting phenolic precursors are not readily available and are expensive to prepare. On the other hand, the precursors to 2,5-diacylamidophenols are commercially available and cheap.

It is a problem to be solved to provide a magenta azine dye-forming coupler which exhibits excellent coupling activity with the oxidized product of a color developing agent and which rapidly and efficiently converts from a cyan to the desired magenta azine dye which coupler at the same time has excellent coupler solvent solubility and provides an image dye that has good absorption characteristics, and good stability to heat, light, or moisture. It is further desirable to provide a coupler which is readily prepared from inexpensive precursors in a short number of steps.

SUMMARY OF THE INVENTION

A photographic element and imaging process employ a light-sensitive silver halide emulsion layer having associated therewith a magenta azine dye-forming coupler which is a phenol having (1) an acylamino group in the 2-position wherein the amino nitrogen contains a substituent which is an aliphatic or aromatic group;

(2) hydrogen or a coupling-off group in the 4-position; and (3) a sulfonamide group in the 5-position.

The invention also encompasses a process for forming an image in an element of the invention which has been exposed imagewise comprising contacting the element with a color developing chemical.

The invention provides a photographic element which contains a coupler that efficiently produces a suitable magenta dye within the time frame of modern development processes. The coupler is readily manufactured from available raw materials.

DETAILED DESCRIPTION OF THE INVENTION

The coupler of the invention is a magenta azine dye-forming coupler which is a phenol having (1) an acylamino group in the 2-position wherein he amino nitrogen contains a substituent which is an aliphatic or aromatic group;

(2) hydrogen or a coupling-off group in the 4-position; and (3) a sulfonamido group in the 5-position.

Thus, the coupler is a phenol having particular types of substituents at the 2- and 5-positions while the hydrogen or coupling-off group at the 4-position may be any group known for use as a coupling-off group.

The 4-position is the coupling position of the coupler where the reaction with the oxidized developer occurs to effect dye formation. This position is filled by a hydrogen atom or a coupling-off group of any of the types well-known in the art. Such groups are typically a halogen, or are linked to the remainder of the coupler by sulfur, oxygen, or a heterocycle element such as nitrogen.

The 5-position component is a sulfonamido group. The sulfonamido group contains an aliphatic or aromatic group attached to the sulfur atom. Typical aliphatic or aromatic groups are as mentioned for substituents of the invention hereafter and include e.g., methyl, ethyl, benzyl, octyl, phenyl, 1-naphthyl, p-nitrophenyl, p-cyanophenyl, m-hexadecylsulfonamidophenyl), a fluoroalkyl group (e.g. trifluoromethyl, heptafluoropropyl), a carboxy alkyl or an alkoxylcarbonylalkyl group (e.g., carboxymethyl, butoxycarbonylmethyl).

The 2-position component is a particular type of acylamino group. The group contains a substituent on both the nitrogen and on the acyl portion of the acylamino group. For the substituent on the acylamino nitrogen, an aliphatic or aromatic group (e.g., methyl, ethyl, butyl, dodecyl, phenyl, p-dodecyloxyphenyl, benzyl) may be employed. As a substituent joined at the acyl carbon, examples include an aliphatic or aromatic group (e.g., methyl, propyl, hexadecyl, Phenyl, m-pentadecylphenyl, 3-(2,4-di-t-pentylphenoxy)butyl, 1-naphthyl, 4-dodecyloxylnaphthyl); and an aliphatic or aromatic amino group (e.g., butylamino, hexadecylamino, phenylamino, p-carboxyphenylamino).

The magenta azine dye-forming coupler in accordance with the invention may be represented by the formula:

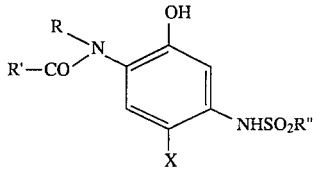

(I)

wherein X represents a hydrogen atom or a group, such as a halogen atom, which can be split off by the reaction of said coupler with an oxidized color developer; R represents an aliphatic or aromatic group (e.g., methyl, ethyl, butyl, dodecyl, phenyl, p-dodecyloxyphenyl, benzyl); R' represents an aliphatic or aromatic group (e.g., methyl, propyl, hexadecyl, phenyl, m-pentadecylphenyl, 3-(2,4-di-t-pentylphenoxy)butyl, 1-naphthyl, 4-dodecyloxylnaphthyl); an aliphatic or aromatic amino group (e.g., butylamino, hexadecylamino, phenylamino, p-carboxyphenylamino); R" represents an aliphatic or aromatic group (e.g., methyl, ethyl, benzyl, octyl, phenyl, 1-naphthyl, p-nitrophenyl, p-cyanophenyl, m-hexadecylsulfonamidophenyl), a fluoroalkyl group (e.g. trifluoromethyl, heptafluoropropyl), a carboxy alkyl or an alkoxylcarbonylalkyl group (e.g., carboxymethyl, butoxycarbonylmethyl).

The "aliphatic" group as referred to herein indicates a linear, branched or cyclic hydrocarbon group which may be substituted or unsubstituted, and may be saturated or unsaturated. The term "aromatic" indicates a phenyl, naphthyl, or heterocyclic aromatic ring and may be substituted or unsubstituted.

Generally, a ballast group is an organic radical of such size and configuration as to confer on the coupler molecule sufficient bulk to render the coupler substantially nondiffusible from the layer in which it is coated in a photographic element. Thus, the combination of groups R, R', and R" from formula (I) are chosen to meet this criteria. To be effective these ballast groups must have a total number of 8 to 48 carbon atoms or more, and preferably be located at R' and R" of formula (I).

Preferably, the couplers of formula (I) are those in which R" comprises an aryl or heterocyclic group which is further substituted with a photographically useful group (e.g., a dye group, a bleach accelerator, or a development inhibitor).

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, -butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-toctylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The following are provided as further examples of couplers useful in photographic elements of the invention:

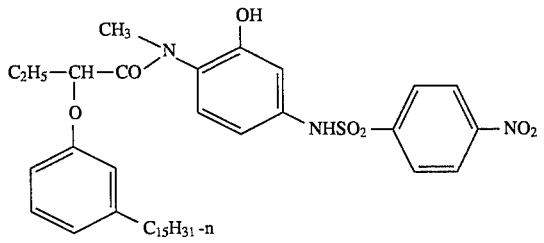

M-1

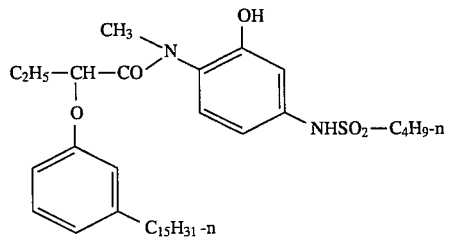

M-2

-continued
M-3
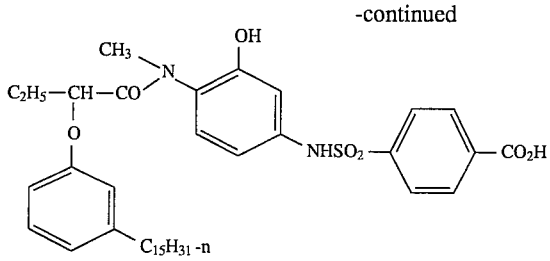
M-4
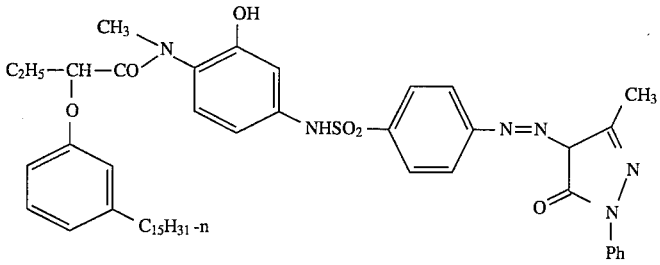
M-5
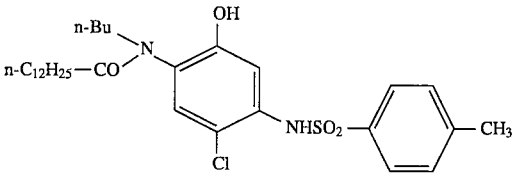
M-6
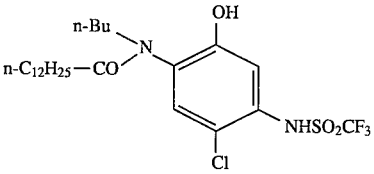
M-7
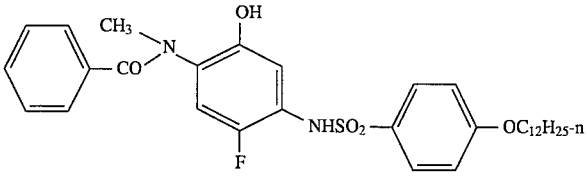
M-8
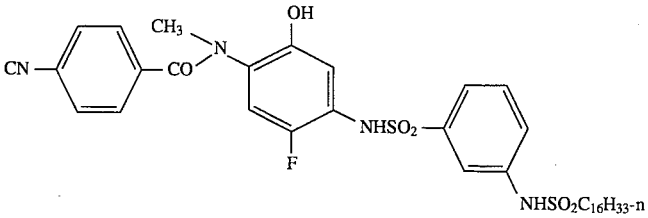
M-9
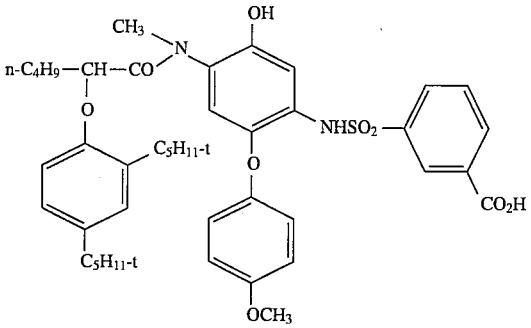

-continued
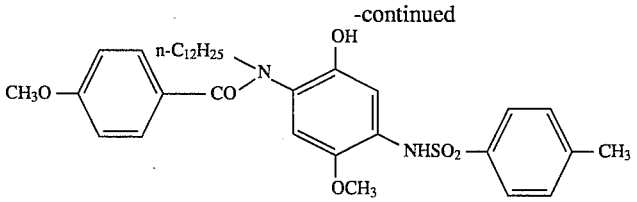
M-10
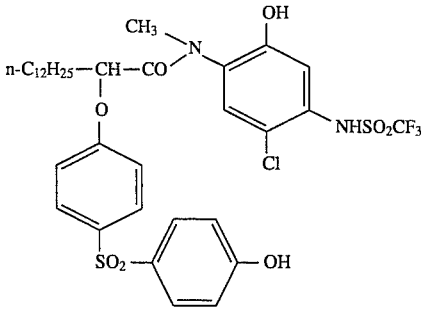
M-11
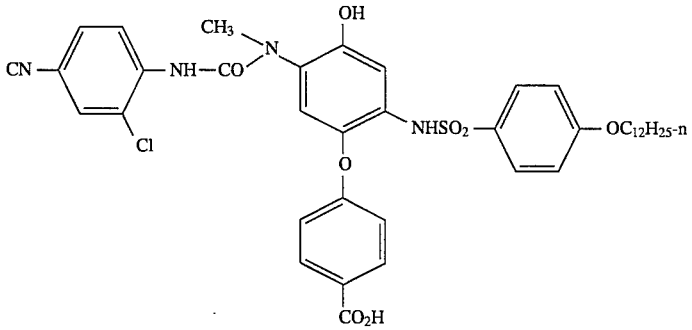
M-12
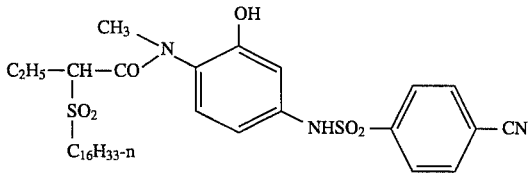
M-13
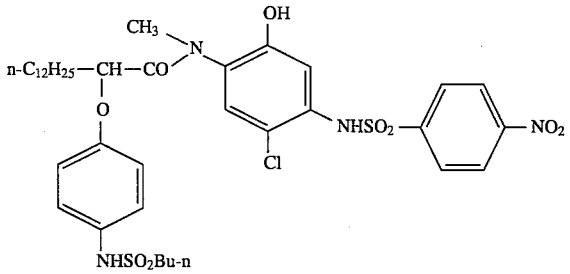
M-14
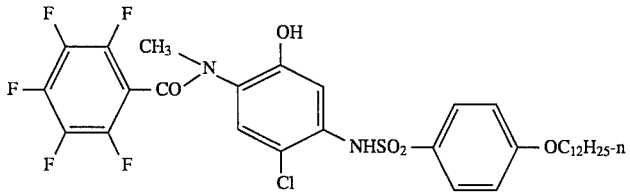
M-15
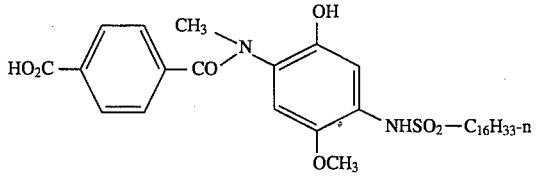
M-16

-continued

M-17

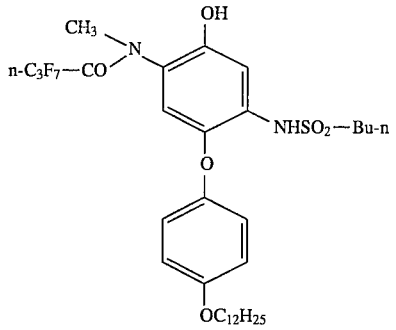

M-18

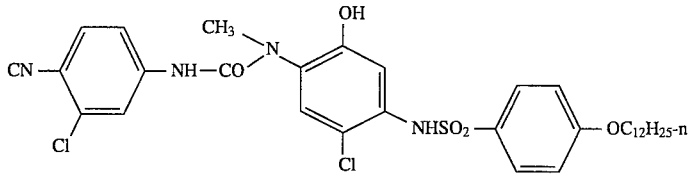

M-19

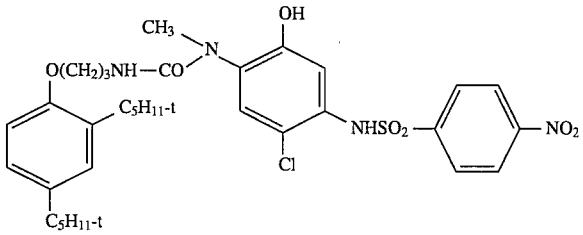

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 48 carbon atoms. Representative substituents on such substituent groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituent groups typically contain 1 to 42 carbon atoms. Such substituent groups can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference.

In the following discussion of suitable materials for use in the emulsions and elements of this invention, reference will be made to *Research Disclosure,* September 1994, Item 36544, available as described above, which will be identified hereafter by the term "Research Disclosure" The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Further examples of specific coupling-off groups are F, Br, —SCN, —$OCH_3$, —$OC_6H_5$, —$OCH_2C(=O)NHCH_2CH_2OH$, —$OCH_2C(=O)NHCH_2CH_2OCH_3$, —$OCH_2C(=O)NHCH_2CH_2OC(=O)OCH_3$, —NHSO2$CH_3$, —OC(=O)$C_6H_5$, —NHC(=O)$C_6H_5$, —OSO2$CH_3$, —P(=O)$(OC_2H_5)_2$, —$S(CH_2)_2CO_2H$.

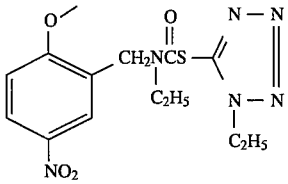

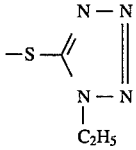

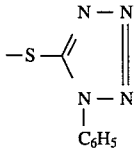

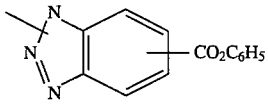

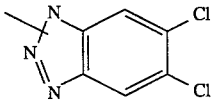

-continued

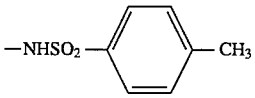

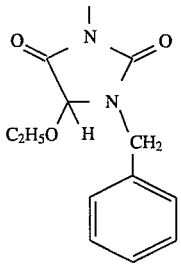

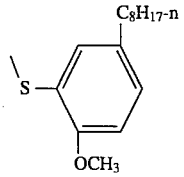

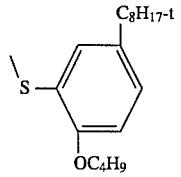

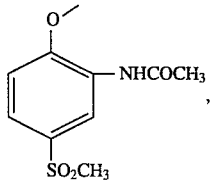

and

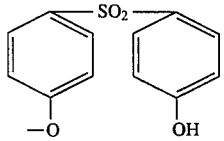

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298, 443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. Nos. 4,301,235; 4,853, 319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983, 608; 4,070,191; and 4,273,861; German Applications DE 2,706,117 and DE 2,643,965; UK. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3 -((2-(4-ethoxy-2,5-dioxo-3-(phenylmethyl)-1 -imidazolidinyl)-3-(4-methoxyphenyl)-1,3 -dioxopropyl)amino)-, dodecyl ester and a slow yellow layer containing the same compound together with "Coupler 2": Propanoic acid, 2-[[5-[[4-[2-[[[2,4 -bis(1,1-dimethylpropyl)phenoxy]acetyl]amino]-5[-(2,2,3,3,4,4,4-heptafluoro-1-oxobutyl)amino]-4hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1 -tridecanoylethoxy)carbonyl)anilino)-3-oxo-2-((4)(5)(6)-(phenoxycarbonyl) 1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4bis(1,1-dimethylpropyl)phenoxy)-1 -oxobutyl)amino)-N-(4,5-dihydro-5-oxo-1-(2,4,6-trichlorophenyl)-1 H-pyrazol-3-yl)-, "Coupler 5": Benzamide, 3-((2-(2,4 -bis(1,1-dimethylpropyl)phenoxy)-1 -oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6(((3 -(dodecyloxy)propyl) amino)carbonyl)-5-hydroxy-1 -naphthalenyl)-, 2-methylpropyl ester , "Coupler 7": Acetic acid, ((2-((3-(((3-(dodecyloxy)propyl)amino)carbonyl)-4 -hydroxy-8-(((2-methylpropoxy)carbonyl) amino)-1-naphthalenyl)oxy )ethyl)thio)-, and "Coupler 8" Benzamide, 3-((2-(2,4-bis(1,1 -dimethylpropyl)phenoxy)-1-oxobutyl)amino)-N-(4,5-dihydro-4-((4-methoxyphenyl)azo)-5 -oxo-1-(2,4,6-trichlorophenyl)-1 H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6 -trichlorophenyl)-4,5-dihydro-5-oxo-1H-pyrazol-3-yl]-2 -methyl-2-propenamide; and "Coupler 10": Tetradecanamide, N-(4-chloro-3-((4-((4-((2,2 -dimethyl-1-oxopropyl) amino)phenyl)azo)-4,5-dihydro-5-oxo-1 -(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4 -hydroxy-1-naphthalenyl) oxy)ethoxy)phenyl)azo)-4 -hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-( 3,5-dichloro-2-hydroxy-4-methylphenyl)-, "Coupler 2": Acetamide, 2-(2,4-bis(1,1-dimethylpropyl)phenoxy)-N-( 3,5-dichloro-2-hydroxy-4-, and UV Stabilizers: Phenol, 2-(5-chloro-2H-benzotriazol-2-yl)-4,6-bis(1,1 -dimethylethyl)-;Phenol, 2-(2H-benzotriazol-2-yl)-4-( 1,1-dimethylethyl)-;Phenol, 2-(2H-benzotriazol-2 -yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1 -dimethylpropyl)phenoxy)-1-oxobutyl)amino)-2 -chlorophenyl)-.alpha.-(2,2-dimethyl-1-oxopropyl)-4 -ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4 -(1-(((2-chloro-5-

((dodecylsulfonyl)amino)phenyl)amino)carbonyl)-3,3 -dimethyl-2-oxobutoxy)-, 1-methylethyl ester; a mid yellow layer containing Coupler 1 and "Coupler 2": Benzoic acid, 4-chloro-3 -[[2-[4-ethoxy-2,5-dioxo-3-(phenylmethyl)-1 -imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5 -dichlorophenyl)-4,5-dihydro-5-oxo-1H-pyrazol-3-yl]-2 -methyl-2-propenamide; "Coupler 4": Benzamide, 3-((2-( 2,4-bis(1,1-dimethylpropyl)phenoxy)-1 -oxobutyl)amino)-N-(4,5-dihydro-5-oxo-1-(2,4,6-trichlorophenyl)-1 H-pyrazol-3-yl)-; and "Coupler 5": Benzamide, 3-(((2,4 -bis(1,1-dimethylpropyl)phenoxy) acetyl)amino)-N-(4,5 -dihydro-5-oxo-1-(2,4,6-trichlorophenyl)-1H-pyrazol-3 -yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2 -cyanophenoxy)-N-(4-((2,2,3,3,4,4,4-heptafluoro-1 -oxobutyl)amino)-3-hydroxyphenyl)-; a mid cyan containing "Coupler 7": Butanamide, N-(4-((2-(2,4-bis( 1,1-dimethylpropyl)phenoxy)-1-oxobutyl)amino)-2 -hydroxyphenyl)-2,2,3,3,4,4,4-heptafluoro- and "Coupler 8": Hexanamide, 2-(2,4-bis(1,1 -dimethylpropyl)phenoxy)-N-(4-((2,2,3,3,4,4,4-heptafluoro-1-oxobutyl)amino)-3 -hydroxyphenyl)-; and a slow cyan layer containing Couplers 6, 7, and 8;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Preferably, the coupling-off group is H, halogen, or an aryloxy group, and more preferably, H. F. Cl, or a p-alkoxyphenoxy group.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

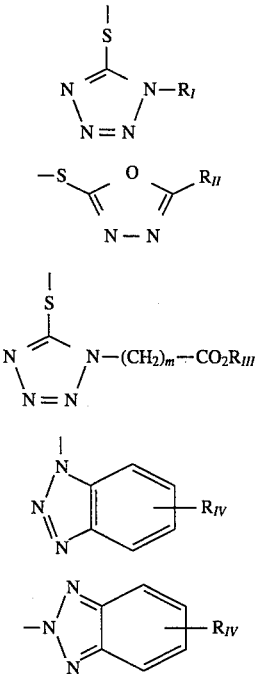

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60 -249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

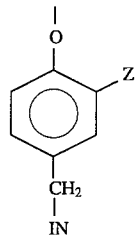

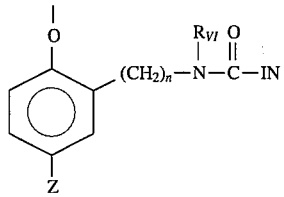

wherein IN is the inhibitor moiety, Z is selected from the group consisting of nitro, cyano, alkylsulfonyl; sulfamoyl (—$SO_2NR_2$); and sulfonamido (—NRSO2R) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

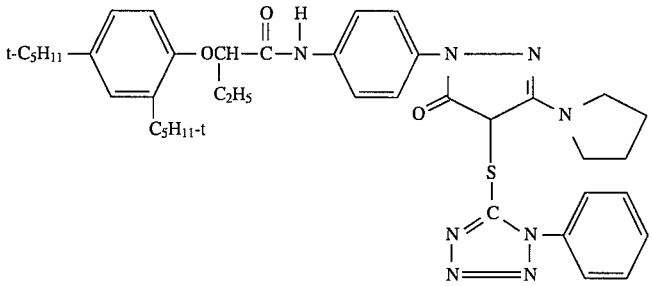

D2

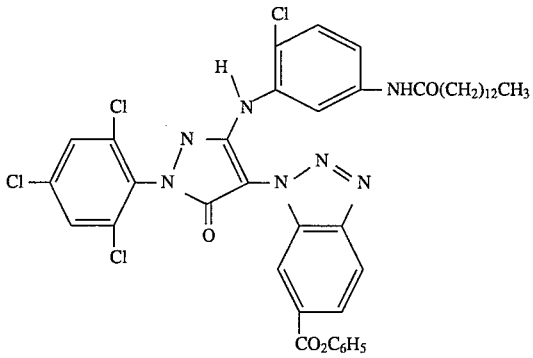

-continued
D3
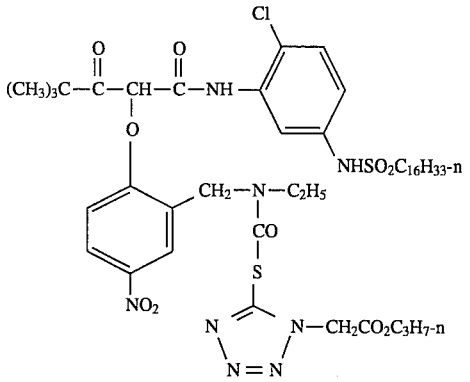
D4
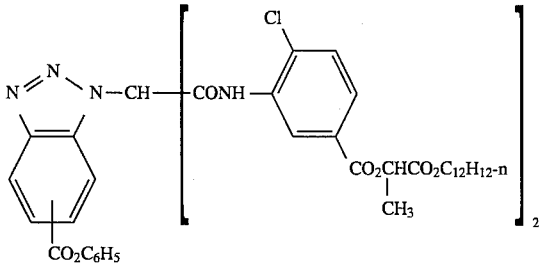
D5
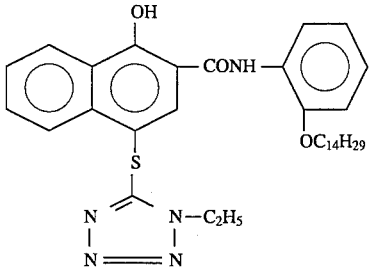
D6
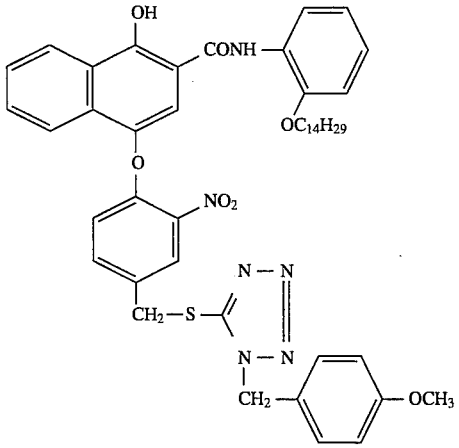

-continued
D7
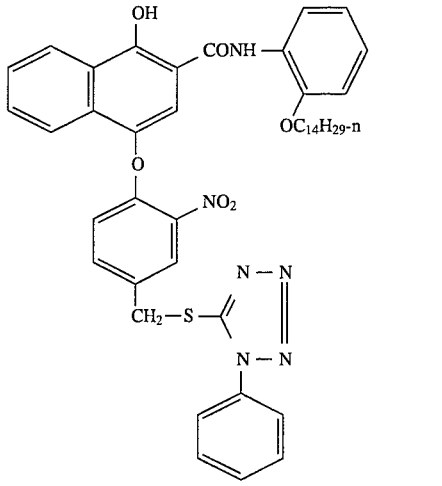
D8
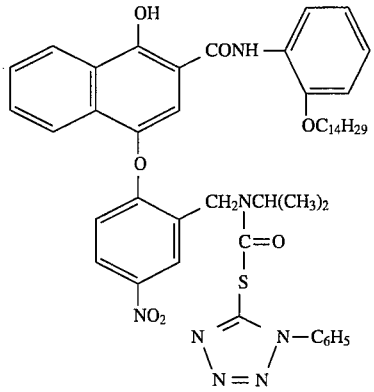
D9
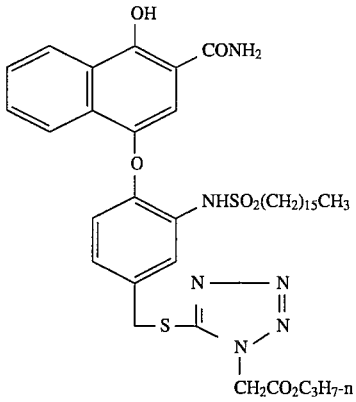
D10
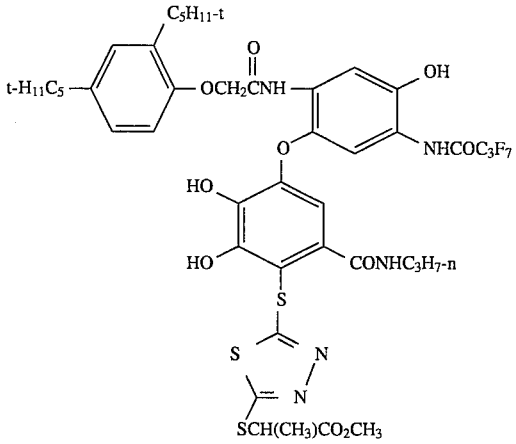

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90 -072,632; 90-072,633; 90-072, 634; 90-077,822; 90 -078,229; 90-078,230; 90-079,336; 90-079,337; 90 -079,338; 90-079,690; 90-079,691; 90-080, 487; 90 -080,488; 90-080,489; 90-080,490; 90-080,491; 90 -080,492; 90-080,494; 90-085,928; 90-086,669; 90 -086, 670; 90-087,360; 90-087,361; 90-087,362; 90 -087,363; 90-087,364; 90-088,097; 90-093,662; 90 -093,663; 90-093, 664; 90-093,665; 90-093,666; 90 -093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such as the RA-4 process of Eastman Kodak Company as described in the British journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.
Suitable stabilizers for the photographic elements of this invention include the following:
S-1
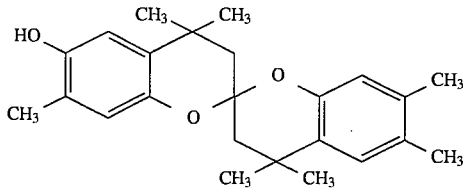
S-2
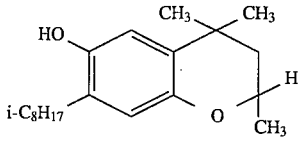
S-3
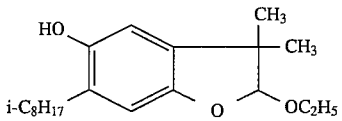
S-4
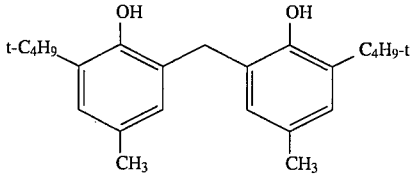
S-5
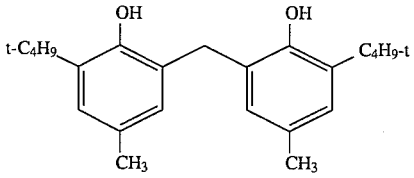
S-6
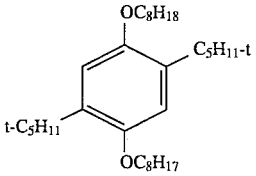
S-7
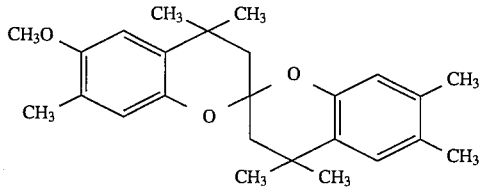
S-8
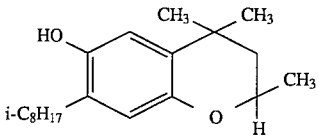
S-9
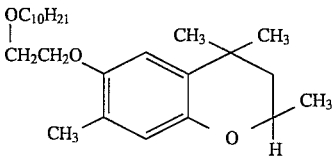
-continued
S-10
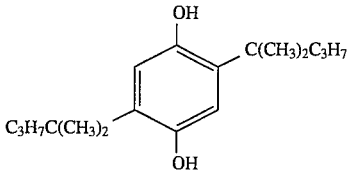
S-11
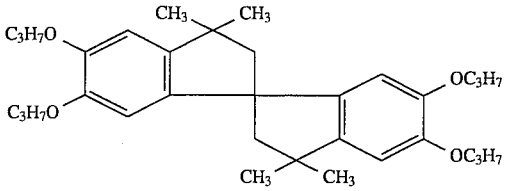
S-12
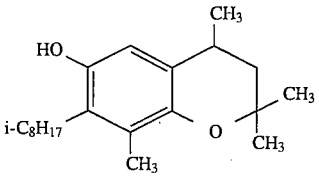
S-13
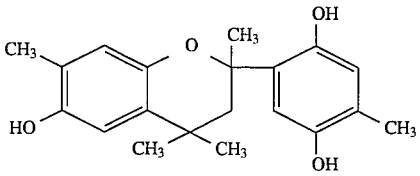
S-14
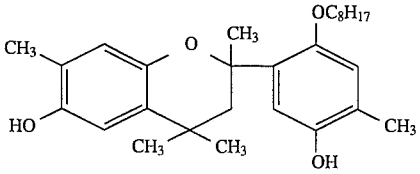
S-15
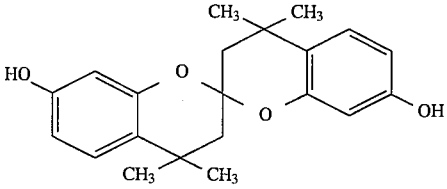
S-16
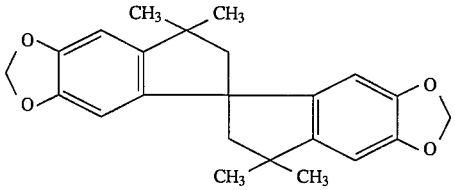
S-17
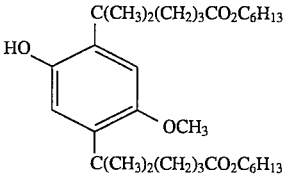

-continued

S-18

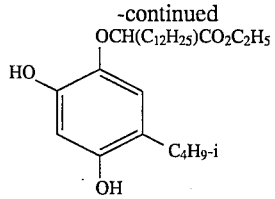

S-19

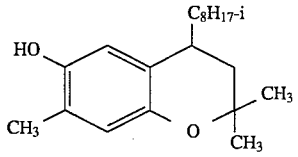

S-20

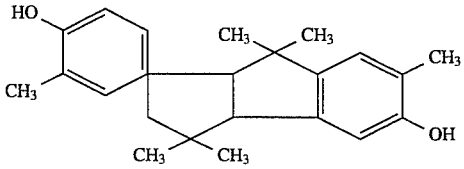

The couplers of the present invention may be prepared by methods known in the art and such methods are exemplified in the preparation of couplers M-1, M-2, and M-4.

Preparation of
2-N-methy-N-a-(m-pentadecylphenoxy)butyrylamido]-5 -(4-nitro-phenylsulfonamido)phenol (M-1)

(A) 2-N-methy-N-a-(m-pentadecylphenoxy)butyrylamido] -5 -nitrophenol

To a solution of 8.4 g (0.05 mol) 2 -N-methylamino-5-nitrophenol in 100 mL THF was added with stirring 7.3 g (0.06 mol) of N,N-dimethylaniline and 20.8 g (0.51 mol) of 2-(m-pentadecylphenoxy)butyryl chloride. After stirring at room temperature for 3 h the reaction mixture was poured into water containing 5 mL of hydrochloric acid. The solid which precipitated out was collected, washed with water, and recrystallized from MeOH. Yield of yellow solid was 2.2 g (82%); m.p. 51°–53° C.

Calcd. for $C_{32}H_{48}N_2O_5$: C, 71.08; H, 8.95; N, 5.18
Found: C, 7108; H, 8.77; N, 508

(B) 2-[N-methyl-N-a-(m-pentadecylmhenoxy)butyrylamido]-5 -(0-nitrophenyl-sulfonamido)phenol To a solution of 10.8 g (0.02 mol) of 2 -[N-methyl-N-a-(m-pentadecylphenoxy)butyrylamido]-5-nitrophenol prepared as described above, in 100 mL THF was added 1.0 g of 10% palladium on charcoal. The mixture was hydrogenated under 50 lbs of $H_2$ for 3 h. The catalyst was removed by filtration through celite. The crude amine was used as such in the next stage.

To the filtrate containing the crude amine was added 30 mL pyridine and a solution of 5.5 g (0.025 mol) p-nitrobenzenesulfonyl chloride in 20 mL THF. The mixture was stirred at room temperature for 10 h, poured into water, and the oil which separated was extracted with ether. The ether extracts were dried over $MgSO_4$, filtered, and the solvent removed under reduced pressure. The residual gum was taken up in boiling MeOH and allowed to crystallize at room temperature. Yield of white crystalline solid was 10.4 g (75%); m.p. 80°–81° C. The structure of the compound corresponding to coupler M-1 of the invention is consistent with its $^1H$ NMR spectrum.

Calcd. for C38H53N3O7S: C, 65.59; N, 7.68; H, 6.04; S, 4.61
Found: C, 65.85; N, 7.94; H, 5.91; S, 4.75

Preparation of
2-[N-methyl-N-a-(m-pentadecylphenoxy)butyrylamido]-5 -butyl-sulfonamidophenol (M-2)

(C) To a solution of 8.1 g (0.015 mol) of 2[N-methyl-N-a-(m-pentadecylphenoxy)butyrylamido]-5-nitrophenol prepared as described above, in 100 mL THF was added 1.0 g of 10% palladium on charcoal. The mixture was hydrogenated for 3 h under 50 lbs of $H_2$ at room temperature. The catalyst was removed by filtration through celite. The crude amine was used as such in the next stage.

To the THF filtrate containing the crude amine was added with stirring 30 mL pyridine and 2.6 g (0.016 mol) of 1-butanesulfonyl chloride. The mixture was stirred for 10 h, poured into water, and the oil which separated was extracted with ether. The ether extracts were dried over $MgSO_4$, filtered, and the solvent removed under reduced pressure. The residual gum was taken up in $CH_2C_{12}$ and chromatographed through a silica gel column eluting with $CH_2Cl_2$-EtOAc (9:1). The pure compound corresponding to coupler M-2 of the invention was isolated as a white amorphous solid. Its structure was consistent with its $^1H$ NMR spectrum. Yield was 6.2 g (65%).

Calcd. for $C_{36}H_{58}N_2O_5S$: C, 68.53; H, 9.27; N, 4.44
Found: C, 68.23; H, 9.00; N, 4.28

Preparation of 2-[N-methyl-N-a-(m-pentadecylphenoxy)butyylamido]-5-[1-phenyl-3-methyl-5 -oxo-4-(p-azophenyl)sulfonamido]phenol (M-4)

(D) TO a solution of 8.1 g (0.015 mol) of 2 -[N-methyl-N-a-(m-pentadecylphenoxy)butyrylamido]-5-nitrophenol prepared as described above, in 100 mL THF was added 1.0 g of palladium on charcoal. The mixture was hydrogenated at room temperature for 3 h under 50 lbs of $H_2$. The catalyst was removed by filtration through celite. The crude amine was used as such in the next stage.

To the THF filtrate containing the crude amine was added with stirring 30 mL pyridine and a solution of 5.7 g (0.015 mol) of 1-phenyl-5-methyl-4 -(p-chlorosulfonylphenylazo)-5-pyrazolone in 30 mL THF. The mixture was stirred for 10 h at room temperature, poured into water, and the gum which separated out was collected. After drying, the crude mixture was triturated with ligroine and recrystallized from $CH_3CN$ to give 8.0 g (63%) of crystalline yellow solid; m.p. 132°–134° C. The structure of the compound corresponding to coupler M-4 of the invention is consistent with its $^1H$ NMR spectrum.

Calcd. for $C_{48}H_{62}N_6O_6S$: C, 67.74; H, 7.34; N, 9.87
Found: C, 67.54; H, 7.22; N, 9.71

Other couplers of the present invention can be prepared by the same methods as described above.

Preparation of Photographic Elements

Dispersions of the couplers were prepared in the following manner. The quantities of each component are found in Table I. In one vessel, the coupler, coupler solvent (dibutyl phthalate), and ethyl acetate were combined and warmed to dissolve. In a second vessel, the gelatin, a naphthalene sulfonic acid based anionic surfactant supplied as Alkanol XC by E. I. DuPont Co. and water were combined and warmed to about 40° C. The two mixtures were mixed together and passed three times through a Gaulin colloid mill.

TABLE I

| | Dispersion No. | Coupler No. | Grams Coupler | Grams Coupler Solvent | Grams Ethyl Acetate | Grams 12.5% Gelatin | Grams Alkanol XC (10%) | Grams Water |
|---|---|---|---|---|---|---|---|---|
| Comparison | 1 | C-1 | 1.541 | 1.541 | 6.615 | 41.69 | 5.00 | 27.44 |
| " | 2 | C-2 | 1.615 | 1.615 | 6.459 | 41.69 | 5.00 | 27.00 |
| " | 3 | C-3 | 1.437 | 1.437 | 4.310 | 41.69 | 5.00 | 29.50 |
| Invention | 4 | M-1 | 1.648 | 1.648 | 6.592 | 41.69 | 5.00 | 26.80 |
| " | 5 | M-2 | 1.492 | 1.492 | 5.967 | 41.69 | 5.00 | 27.74 |
| " | 6 | M-3 | 1.700 | 1.700 | 6.800 | 41.69 | 5.00 | 26.49 |

The comparative couplers employed in the testing were as follows.

C-1

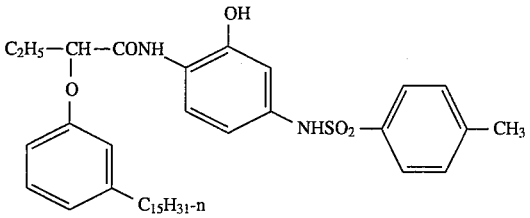

C-2

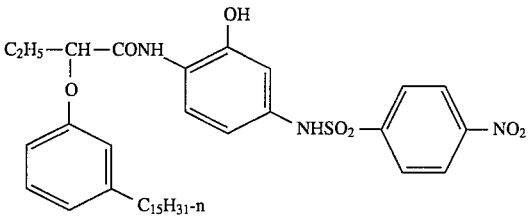

C-3

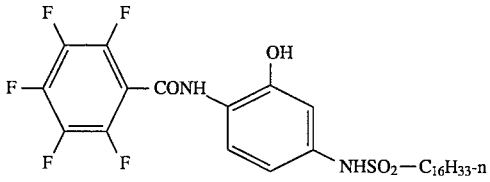

The photographic elements were prepared by coating the following layers in the order listed on a resin-coated paper support:

| | |
|---|---|
| 1st Layer | |
| Gelatin | 3.77 g/m$^2$ |
| Coupler Dispersion (see Table II) | 1.61 × 10$^{-6}$ mole coupler/m$^2$ |
| Green-sensitized AgBrI emulsion | 0.91 mg Ag/m$^2$ |
| 2nd Layer | |
| Gelatin | 2.69 g/m$^2$ |
| Bis(vinylsulfonyl)methane | 0.11 g/m$^2$ |

Exposing and Processing of Photographic Elements

The photographic elements were given stepwise exposures to green light and processed as follows at 36.9° C.:

| | |
|---|---|
| First developer | 4.0 min |
| Wash (running water) | 2.0 min |
| Reversal bath | 2.0 min |
| Color developer | 6.0 min |
| Bleach accelerator | 2.0 min |
| Bleach | 6.0 min |
| Fixer | 4.0 min |
| Wash (running water) | 4.0 min |
| KODAK PHOTOFLO ™ (wetting agent containing wash solution 1 part in 200 parts water) | 0.5 min |

The processing solutions were of the following compositions:

| | |
|---|---|
| First Developer | |
| Water | 600.00 mL |
| Aminotris(methylenephosphonic acid) pentasodium salt (40% solution) | 1.41 g |
| Diethylenetriaminepentaacetic acid pentasodium salt (40% solution) | 6.26 g |
| Potassium sulfite (45%) | 66.10 g |
| Sodium bromide | 2.34 g |
| Sodium thiocyanate | 1.00 g |
| Potassium iodide | 4.50 mg |
| Potassium hydroxide (45%) | 9.52 g |
| 4-Hydroxymethyl-4-methyl-1-phenyl-3-pyrazolidinone | 1.50 g |
| Potassium carbonate | 14.00 g |
| Sodium bicarbonate | 12.00 g |
| Potassium hydroquinone sulfonate | 23.40 g |
| Acetic acid | 0.58 g |
| Water to make | 1.005 L |
| pH @ 26.7° C. adjusted to 9.60 ± 0.05 | |
| Reversal Bath | |
| Water | 600.00 mL |
| Propionic acid | 11.90 g |
| Stannous chloride | 1.65 g |
| p-Aminophenol | 0.50 mg |
| Sodium hydroxide (50%) | 9.92 g |
| Aminotris(methylenephosphonic acid) pentasodium salt (40% solution) | 21.10 g |
| Water to make | 1.00 L |
| pH @ 26.7° C. adjusted t 5.75 ± 0.05 | |
| Color Developer | |
| Water | 800.00 mL |
| Aminotris(methylenephosphonic acid) pentasodium salt (40% solution) | 6.68 g |
| Phosphoric acid (75%) | 17.40 g |
| Sodium bromide | 0.65 g |
| Potassium iodide | 37.50 mg |
| Potassium hydroxide (45%) | 61.60 g |
| Sodium sulfite | 6.08 g |
| Sodium metabisulfite | 0.50 g |
| Citrazinic acid | 0.57 g |
| N-[2-[(4-amino-3-methylphenyl)ethylamino]ethyl] methanesulfonamide, sesquisulfate | 10.42 g |
| 2,2-(Ethylenedithio)diethanol | 0.87 g |
| Acetic acid | 1.16 g |
| Sodium carboxymethylcellulose 7LF (Hercules) | 0.95 g |
| Sodium carboxymethylcellulose 7H3SF (Hercules) | 0.71 g |
| Water to make | 1.005 L |
| pH @ 26.7° C. adjusted to 11.75 ± 0.05 | |
| Conditioner | |
| (Ethylenedinitrilo)tetraacetic acid | 8.00 g |
| Potassium sulfite | 13.10 g |
| Thioglycerol | 0.52 g |
| Water to make | 1.00 L |

-continued

| Bleach | |
|---|---|
| Water | 500.00 mL |
| Potassium nitrate | 25.00 g |
| Ammonium bromide | 64.20 g |
| Ammonium ferric ethylenediaminetetraacetate (1.56M, pH 7.05, 44% by wt; contains 10% molar excess ethylenediaminetetraacetic acid) | 284.00 g |
| Hydrobromic acid (48%) | 51.20 g |
| (Ethylenedinitrilo)tetraacetic acid | 4.00 g |
| Potassium hydroxide (45%) | 3.86 g |
| Water to make | 1.00 L |
| **Fixer** | |
| Water | 500.00 mL |
| Solution of ammonium thiosulfate (56.4%) + Ammonium sulfite (4%) | 124.70 g |
| (Ethylenedinitrilo)tetraacetic acid | 0.59 g |
| Sodium metabisulfite | 7.12 g |
| Sodium hydroxide (50%) | 2.00 g |
| Water to make | 1.00 L |
| pH @ 26.7° C. adjusted to 6.60 ± 0.10 | |

Photographic Test Results

The couplers of the invention were effective in forming magenta dyes upon processing. The comparison couplers formed cyan dyes which were transformed only very slowly into magenta dyes (over a period of many weeks at room temperature or several days when incubated at 65° C./60% R.H.). The densities to green and red light ($D_g$ and $D_r$, respectively) were read immediately after processing and are shown in Table II. The ratio of green density to red density ($D_g/D_r$) is an indication of the degree of conversion of the cyan dye to the magenta dye, a higher number indicating a greater degree of conversion. Due to the inherent red absorption of the magenta dye, there is a practical maximum to the ratio that can be achieved.

TABLE II

| Dispersion No. | Coupler | $D_g$ | $D_r$ | $D_g/D_r$ | |
|---|---|---|---|---|---|
| 1 | C-1 | 0.99 | 2.97 | 0.33 | Comparison |
| 2 | C-2 | 1.12 | 2.74 | 0.41 | " |
| 3 | C-3 | 1.16 | 2.13 | 0.54 | " |
| 4 | M-1 | 1.90 | 0.07 | 27.14 | Invention |
| 5 | M-2 | 1.37 | 0.08 | 17.13 | " |
| 6 | M-3 | 2.04 | 0.08 | 25.50 | " |

The data clearly show that the couplers of the invention generated magenta dye during normal processing to a much greater degree than did the comparison couplers, whose dyes remained substantially in the cyan form. Based on spectral analysis, the couplers of the invention left no residual cyan dye, indicating that the cyan dye which was formed initially was completely converted to the magenta azine dye during the color development process.

What is claimed is:

1. A photographic element comprising a light-sensitive silver halide emulsion layer having associated therewith a coupler which is a phenol having (1) an acylamino group in the 2-position wherein the amino nitrogen contains a substituent which is an aliphatic or aromatic group;

(2) hydrogen or a coupling-off group in the 4-position; and (3) a sulfonamido group in the 5-position;

wherein said coupler forms a magenta colored dye upon coupling with a p-phenylenediamine color developing agent.

2. The element of claim 1 wherein the the acylamino and the sulfonamido groups independently contain a substituent group of up to 42 carbon atoms.

3. The element of claim 1 wherein the acylamino nitrogen substituent is an alkyl group of up to 22 carbon atoms.

4. The element of claim 1 wherein the acylamino nitrogen substituent is an alkyl group of up to 16 carbon atoms.

5. The element of claim 1 wherein the sulfonamido substituent includes an alkyl group of up to 42 carbon atoms.

6. The element of claim 1 wherein the sulfonamido substituent includes an alkyl group of up to 32 carbon atoms.

7. The element of claim 6 wherein the sulfonamido substituent includes an unsubstituted alkyl or an alkyl group substituted with a phenoxy group, a phenyl group, a sulfone group, a sulfonamido group, fluoride, or an amine group.

8. The element of claim 6 wherein the sulfonamido substituent includes a phenyl group.

9. The element of claim 8 wherein said phenyl group is substituted with fluoride, a carboxy group, cyano or chloride.

10. The element of claim 1 wherein the acylamino contains an acyl substituent which is an unsubstituted alkyl or an alkyl group substituted with fluoride.

11. The element of claim 1 wherein the acylamino contains an acyl substituent which is unsubstituted phenyl or a phenyl group substituted with nitro, carboxy, azo, alkyl, alkoxy, sulfonamido, cyano, or a sulfone group.

12. A photographic element comprising a light-sensitive silver halide emulsion layer having associated therewith a coupler represented by the formula

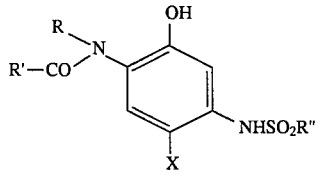

(I)

wherein X represents a hydrogen atom or a coupling-off group; R and R" independently represent an aliphatic or aromatic group; and R' represents an aliphatic or aromatic group or an aliphatic or aromatic amino group;

wherein the coupler forms a magenta colored dye when coupled with a p-phenylenediamine color developing agent.

13. The element of claim 12 wherein R represents a substituent group of up to 42 carbon atoms.

14. The element of claim 12 wherein R represents a substituent is an alkyl group of up to 22 carbon atoms.

15. The element of claim 14 wherein R is an alkyl group of up to 16 carbon atoms.

16. The element of claim 12 wherein R" is an alkyl group of up to 32 carbon atoms.

17. The element of claim 12 wherein R" is an unsubstituted alkyl or an alkyl group substituted with a phenoxy group, a phenyl group, a sulfone group, a sulfonamido group, fluoride, or an amino group.

18. The element of claim 12 wherein R" is a phenyl group.

19. The element of claim 12 wherein R' is an unsubstituted alkyl or an alkyl group substituted with fluoride.

20. The element of claim 12 wherein R' is an unsubstituted phenyl group or a phenyl group substituted with nitro, carboxy, azo, alkyl, alkoxy, sulfonamido, cyano, or a sulfone group.

* * * * *